United States Patent [19]

Korstad et al.

[11] 4,166,501

[45] Sep. 4, 1979

[54] HIGH VERTICAL CONFORMANCE STEAM DRIVE OIL RECOVERY METHOD

[75] Inventors: Ralph J. Korstad, Austin; Wilbur L. Hall, Bellaire, both of Tex.; Ching H. Wu, Goldon, Colo.; Alfred Brown, Houston, Tex.

[73] Assignee: Texaco Inc., White Plains, N.Y.

[21] Appl. No.: 936,439

[22] Filed: Aug. 24, 1978

[51] Int. Cl.[2] ..... E21B 43/24

[52] U.S. Cl. ..... 166/263; 166/245; 166/261; 166/272

[58] Field of Search ..... 166/272, 245, 268, 261, 166/263

[56] References Cited

U.S. PATENT DOCUMENTS

| | | | |
|---|---|---|---|
| 3,393,735 | 7/1968 | Altamira et al. | 166/263 X |
| 3,472,318 | 10/1969 | Woodward | 166/263 X |
| 3,477,510 | 11/1969 | Spillette | 166/272 |
| 3,500,915 | 3/1970 | Fitzgerald | 166/272 |
| 3,537,526 | 11/1970 | Offeringa | 166/272 X |
| 3,572,437 | 3/1971 | Marberry et al. | 166/272 |
| 3,705,625 | 12/1972 | Whitten et al. | 166/272 X |
| 3,946,810 | 3/1976 | Barry | 166/272 |
| 4,086,964 | 5/1978 | Dilgren et al. | 166/272 |
| 4,114,690 | 9/1978 | Cram et al. | 166/272 X |

*Primary Examiner*—Stephen J. Novosad
*Attorney, Agent, or Firm*—Carl G. Ries; Thomas H. Whaley; Jack H. Park

[57] ABSTRACT

The vertical or both vertical and horizontal conformance of a steam drive process is improved and steam override reduced by penetrating the zone between one injector and one producer, with one or more infill wells in fluid communication with the bottom half or less of the formation, and producing petroleum from the infill well after steam channeling has occurred at the production well. After the water cut of the fluids being produced from the infill well reaches 95 percent, the infill well is converted from a producer to an injector and steam is injected into the infill well and fluids are recovered from the production well. When one infill well is employed in a more or less aligned arrangement between injection and production wells, the vertical conformance is improved. When one or more infill wells are positioned in an offset or nonaligned arrangement relative to each injector and producer, conformance in both the horizontal and vertical planes is improved. By this multi-step process involving the infill wells, the amount of oil recovered from the portion of the formation in the recovery zone defined by the injection and production well is increased significantly.

16 Claims, 12 Drawing Figures

INJECTION WELL
PRODUCTION WELL

INJECTION WELL
INFILL WELL
PRODUCTION WELL $\alpha = \beta = 0°$

INJECTION WELL
INFILL WELL
PRODUCTION WELL

INJECTION WELL
INFILL WELL
PRODUCTION WELL

HIGH VERTICAL CONFORMANCE STEAM DRIVE OIL RECOVERY METHOD

FIELD OF THE INVENTION

The present invention concerns a steam throughput or steam drive oil recovery method. More particularly, the present invention involves a steam drive oil recovery method especially suitable for use in relatively thick, viscous oil-containing formations, by means of which viscous oil may be recovered from the formation without experiencing poor vertical conformance caused by steam channeling and overriding which reduces the amount of oil recovered from the formation.

BACKGROUND OF THE INVENTION

It is well recognized by persons skilled in the art of oil recovery that there are formations which contain petroleum whose viscosity is so great that little or no primary production is possible. Some form of supplemental oil recovery must be applied to these formations in order to decrease the viscosity of the petroleum sufficiently that it will flow or can be displaced through the formation to production wells to the surface of the earth. Thermal recovery techniques are quite suitable for viscous oil formations, and steam flooding is the most successful thermal oil recovery technique yet employed in commercial application. Steam may be utilized for thermal stimulation for viscous oil formations by means of a "huff and puff" technique in which steam is injected into a well, allowed to remain in the formation for a soak period, and then oil is recovered from the formation by means of the same well as was used for steam injection. Another technique employing steam stimulation is a steam drive or steam throughput process, in which steam is injected into the formation on a more or less continuous basis by means of an injection well and oil is recovered from the formation from a spaced-apart production well. This technique is somewhat more effective in many applications than the "huff and puff" steam stimulation process since it both reduces the viscosity of the petroleum and displaces petroleum through the formation, thus encouraging production from a production well. While this process is very effective with respect to the portions of the recovery zone between the injection well and production well through which the steam travels, poor vertical conformance is often experienced in steam drive oil recovery processes. A major cause of poor vertical conformance is that steam density is less than the density of other fluids present in the permeable formation, and so steam migrates to the upper portion of the permeable formation and channels across the top of the oil formation to the remotely located production well. Once steam channeling has occurred in the upper portion of the formation, the permeability of the steam-swept zone is increased due to the desaturation or removal of petroleum from the portions of the formation through which steam has channeled. Thus subsequently-injected steam will migrate almost exclusively through the steam-swept channel and very little of the injected steam will move into the lower portions of the formation, and thus very little additional petroleum from the lower portions of the formation will be experienced. While steam drive processes effectively reduce the oil saturation in the portion of the formation through which steam passes by a significant amount, a portion of the recovery zone between the injection and production systems actually contacted by steam is often less than 50 percent of the total volume of that recovery zone, and so a significant amount of oil remains in the formation after completion of the steam drive oil recovery process. The severity of the poor vertical conformance problem increases with the thickness of the oil formation and with the viscosity of the petroleum contained in the oil formation.

Additionally, since the viscosity of steam is much less than the viscosity of petroleum, poor horizontal or areal conformance is usually encountered in steam throughput processes.

In view of the foregoing discussion, and the large deposits of viscous petroleum from which only a small portion can be recovered because of the poor conformance problem, it can be appreciated that there is a serious need for an improved steam drive thermal oil recovery method suitable for use in recovering viscous petroleum from relatively thick formations which will result in improved vertical conformance.

SUMMARY OF THE INVENTION

The process of our invention involves a multi-step process involving at least one injection well and at least one spaced apart production well for injecting steam into the formation and recovering petroleum from the formation as is done in the current practice of state-of-the-art steam drive oil recovery processes. At least one additional well, referred to herein as an infill well, is drilled into the recovery zone of the formation between the injection well and production well and fluid communication between the well and the formation is established with only the lower 50 percent and preferably the lower 25 percent of the viscous oil formation. This well may be completed at the same time the primary injection well and production well are completed, or it may be completed in the formation when it is needed. In practicing our process, steam is injected into the injection well and petroleum is recovered from the production well as is conventionally practiced in the art until steam breakthrough at the production well occurs. At this time, as little as 50 percent or less of the formation will have been swept by steam due to steam channeling through the upper portions of the formation. At this point, production of petroleum is taken from the infill well, which recovers oil from the lower portion of the formation between the primary injection well and the infill well. During the period when the infill well is used for fluid production or for fluid injection, steam injection into the original injection well must be continued and fluid production from the original production well is ordinarily also continued. This step is continued until the fluid being recovered from the infill well reaches about 95 percent water (referred to in the art as 95 percent water cut). At this point, the infill well is converted from production well service to injection well service and steam is injected into the infill well. Steam injection into the infill well continues until live steam production at the production well occurs. Because steam is being injected into the formation in a zone through which steam did not pass in the first stage, the conformance of the steam drive process when viewed in a vertical plane is improved significantly. If the infill well is located more or less on a line between the injection well and production well, vertical conformance is improved. By drilling at least one infill offset from a line between the injection well and production well, preferably one infill well on each side of the line and offset by from 5° to 50° and preferably 15°-35° from the line, the horizontal conformance is also improved.

DESCRIPTION OF THE PREFERRED EMBODIMENTS

Figure 1:
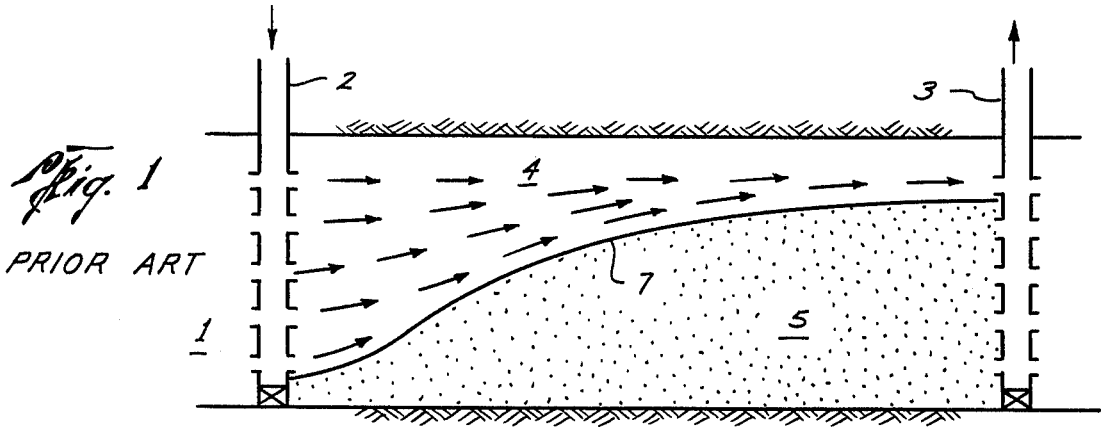
Fig. 1 PRIOR ART
FIG. 1 illustrates a vertical plane view of a subterranean formation penetrated by an injection well and a production well being employed in a state-of-the-art steam drive oil recovery method, illustrating how the injected steam migrates to the upper portions of the formation as it travels through the recovery zone within the formation and between the injection well and production well, thus overriding and bypassing a significant amount of petroleum in the recovery zone.

The problem of steam override inherent in prior art processes, for which the process of our invention is intended as an improvement, may best be understood by referring to the attached drawings, in which FIG. 1 illustrates how a relatively thick, viscous oil formation 1 penetrated by an injection well 2 and a production well 3 is used for a conventional steam drive oil recovery process as is taught in the prior art. Steam is injected into well 2, passes through the perforations in well 2 into the viscous oil formation. Conventional practice is to perforate or establish fluid flow communications between the well and the formation throughout the full vertical thickness of the formation, both with respect to injection well 2 and production well 3. Notwithstanding the fact that steam is injected into the full vertical thickness of the formation, it can be seen that steam migrates both horizontally and in an upward direction as it moves through the formation between injection well 2 and production well 3. The result is the creation of a steamswept zone 4 in the upper portion of the formation and zone 5 in the lower portion of the formation through which little or no steam has passed. Once steam breakthrough at production well 3 occurs, continued injection of steam will not cause any steam to flow through section 5, because (1) the specific gravity of the substantially all vapor phase steam is significantly less than the specific gravity of the petroleum and other liquids present in the pore spaces of the formation, and so gravitational effects will cause the steam vapors to be confined exclusively in the upper portion of the formation, hence the term "steam override," and (2) steam passage through the upper portion of the formation displaces and removes petroleum from that portion of the formation through which it travels, and desaturation of the zone increases the relative permeability of that part of the formation significantly as a consequence of removing the viscous petroleum therefrom. Thus any injected fluid will travel even more readily through the desaturated portion of the formation 4 than it will through the portion of the formation 5 which is near original conditions with respect to viscous petroleum saturation.

Figure 2:
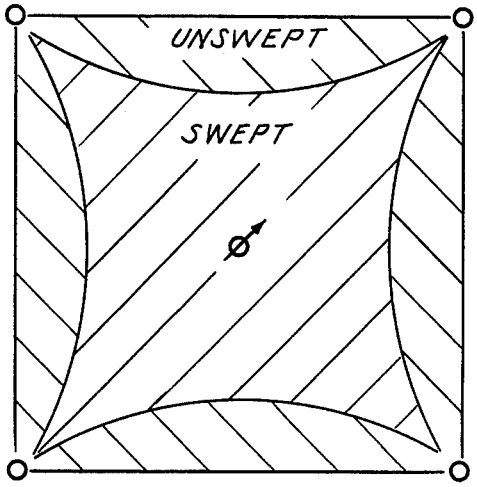
Fig. 2 PRIOR ART
FIG. 2 illustrates the swept and unswept portion of a formation in a horizontal plane in an inverted five spot pattern comprising one central injector and four corner producers, illustrating the poor horizontal conformance in a typical method practiced according to prior art teaching.

FIG. 2 illustrates a view of the swept and unswept zones in a typical inverted five spot pattern, as viewed in a horizontal plane. The swept portion commonly amounts to only 60 to 70 percent of the total pattern area for steam drive processes.

Figure 3:
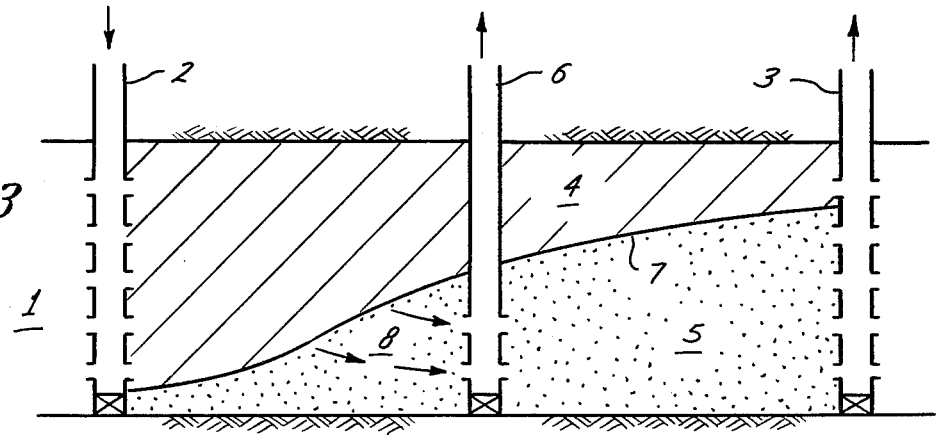
FIG. 3 illustrates the location of the infill well and its use in the first phase of one embodiment of our process in which fluids are recovered from the formation by means of the infill well, as viewed in a vertical plane.

FIG. 3 illustrates how infill well 6 is drilled into the formation, with respect to injection well 2 and production well 3. Infill well 6 must be drilled into the recovery zone within the formation defined by injection well 2 and production well 3. It is not essential that infill well 6 be located on a line between injection well 2 and production well 3, and may be offset in either direction from a straight line arrangement, although one convenient location of infill well 6 would be in alignment with wells 2 and 3. This arrangement achieves maximum improvement in vertical conformance but achieves little or no improvement in horizontal conformance. Similarly, it is not essential that well 6 be located exactly midway between injection well 2 and production well 3, and it is adequate for our purposes if a distance between injection well 2 and infill well 6 be from 25 to 75 percent and preferably from 40 to 60 percent of the distance between injection well 2 and production well 3. Infill well 6 is perforated or fluid flow communication is established by other means between well 6 and the formation, only in the lower 50 percent and preferably the lower 25 percent of the formation. This is essential to the proper functioning of our process.

It is immaterial for the purpose of practicing our process, whether infill well 6 is drilled and completed at the same time as injection well 2 and production well 3, or if such drilling and completion of infill well 6 is deferred until steam breakthrough has occurred at production well 3, or at some intermediate time. If completed prior to use, infill well 6 is simply shut in during the first phase of the process of our invention.

The fluid injected into injection well 2 during all of the steps described herein, as well as that injected into infill well 6 in the process of our invention, will comprise steam, either alone or other substances may be used in combination with steam as is well described in the art. For example, noncondensible gases such as nitrogen or carbon dioxide may be comingled with steam for the purpose of improved oil stimulation or to achieve other objectives. Materials which are miscible with formation petroleum may also be mixed with the steam, such as hydrocarbons in the range of $C_1$ to $C_{10}$, for the purpose of further enhancing the mobilizing effect of the injected fluids. Air may also be comingled with steam in a ratio from 0.05 to 2.0 standard cubic feet of air per pound of steam, which accomplishes a low temperature, controlled oxidation within the formation, and achieves improved thermal efficiency under certain conditions. So long as the fluid injected into injection well 2 comprises a major portion of vapor phase steam, the problem of steam channeling will be experienced in the steam drive process no matter what other fluids are included in the injected steam, and the process of our invention may be incorporated into the steam drive oil recovery process with the resultant improvement in vertical conformance or both vertical and horizontal conformance.

Turning again to the drawings, our invention in its broadest aspect comprises a minimum of three steps to be applied to an oil formation. FIG. 3 illustrates a minimum three-well unit for employing the process of our invention, wherein formation 1 is penetrated by an injection well 2 which is preferably in fluid communication with essentially the full vertical thickness of the formation. Spaced-apart production well 3 is a conventional production well, which is also preferably in fluid communication with essentially the full vertical thickness of the formation. Infill well 6 is shown located about midpoint between well 2 and 3, and within the recovery zone defined by wells 2 and 3, i.e. on or adjacent to a line between wells 2 and 3, and fluid communication is established between well 6 and the lower portion of the formation, in this instance being slightly less than 50 percent of the total thickness of the formation.

In the first step, a thermal recovery fluid comprising steam is injected into the formation by means of injection well 2. Steam enters the portion of the formation immediately adjacent to well 2 through all of the perforations in well 2, and initially travels through substantially all of the full vertical thickness of formation 1. Because the specific gravity of vapor phase steam is significantly less than the specific gravity of other fluids, including the viscous petroleum present in the pore spaces of formation 1, steam vapors migrate in an upward direction due to gravitational effects, and as can be seen in FIG. 1, the portion 4 of the formation 1 swept by steam vapors in the first step represents an ever decreasing portion of the vertical thickness of the formation as the steam travels between the injection well and production well 3. Thus by the time steam arrives at production well 3, only a small fraction of the full vertical thickness of the formation is being contacted by steam. Oil is recovered from the portion of the formation through which the steam vapors travel, although the total recovery from the recovery zone defined by wells 2 and 3 will be significantly less than 50 percent of the total amount of petroleum in the recovery zone. Even though significantly more than 50 percent of the oil present in portion 4 of the formation is recovered by steam, the large amount of oil unrecovered from that portion 5 through which very little of the steam passes causes the total recovery efficiency to be very low. The recovery efficiency as a consequence of this problem is influenced by the thickness of the formation, the well spacing, the viscosity of the petroleum present in the formation at initial conditions, as well as by other factors. Recoveries substantially below 50 percent are not uncommon in field application of steam drive processes.

The first step of our process comprises injecting steam into injection well 2 and recovering fluids from the formation by means of production well 3 and this is continued until steam and/or steam condensate production at well 3 is detected. The preferred embodiment of our method comprises continuing this step until live steam production occurs at well 3. Once steam is being produced in well 3, further production of oil will be at a much diminished rate, since the only mechanism by means of which additional oil can be recovered from the portion of the formation below the steam-swept zone 4 will be by a stripping action, in which oil is recovered along the surface 7 between the steam-swept portion 4 of the formation and portion 5 of the recovery zone through which steam has not passed. Although this mechanism may be continued for very long periods of time and some additional oil can be recovered from the upper surface of zone 5 by this method, the stripping action is extremely inefficient and it is not an economically feasible means of recovering viscous oil from the formation after steam breakthrough occurs at well 3.

In the second step in the process of our invention, infill well 6 is utilized as a production well. It should be understood that a significant amount of oil is recovered from the formation by this step alone which is not recovered at the economic conclusion of the first step. Not only is oil recovered from a volume segment 8 of the recovery zone through which steam does not pass and from which oil is not recovered in a steam drive process such as is illustrated in FIG. 1. We have found that the oil saturation in zone 8 of FIG. 3, that being the portion of the recovery zone between the infill well and injection well 2, occupying the lower thickness of the formation, is actually increased during the period of recovering oil from swept zone 4 in FIG. 1. This is caused by migration of oil mobilized by injected steam, into the portion of the formation through which steam does not travel during this first period. Thus, if the average oil saturation throughout viscous oil formation 1 is in the range of about 55 percent (based on the formation pore volume), injection of steam into the formation may reduce the average oil saturation throughout depleted zone 4 to 15 percent, but the oil saturation in zone 8 may actually increase to a value from 60 to 70 percent. The second step in the process of our invention, in which fluids are recovered from infill well 6, accomplishes steam stimulated recovery of petroleum from zone 8 in the FIG. 3 which is not recoverable by processes taught in the prior art. Because fluid communication only exists between well 6 and the lower portion of the formation, no more than the lower 50 percent and preferably no more than the lower 25 percent of the formation, movement of oil into these perforations results in sweeping a portion of the formation not otherwise swept by steam.

During the above described second step of the process of our invention, steam injection into well 2 must be continued, and production of fluids from well 3 may be continued at the previous or at a decreased rate, or may be discontinued depending on the water cut of fluid being produced at that time.

Figure 4:
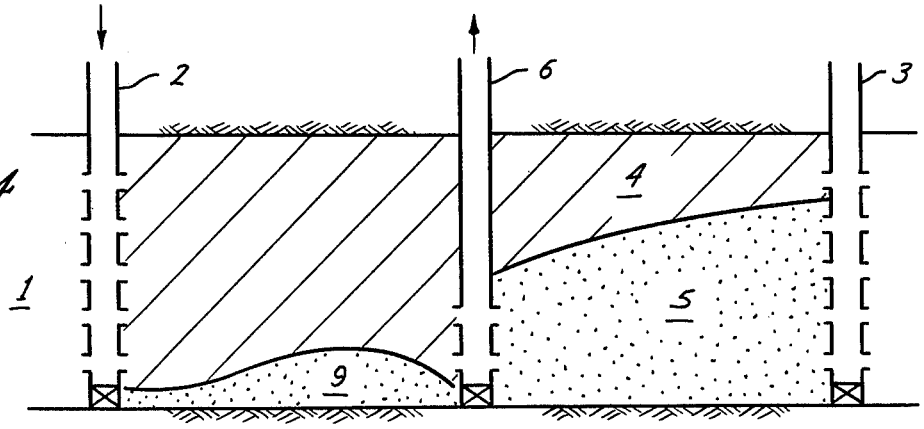
FIG. 4 illustrates the state of the formation at the conclusion of the foregoing step, before steam injection into the infill well has begun, illustrating the additional portion of the formation swept in the first stage of our process.

In FIG. 4, it can be seen that a portion 9 of the formation still remains unswept by the injected steam, but its volume is significantly less than the volume of zone 8 prior to application of the second step of the process of our invention. Once the water cut of the fluid being produced from the formation by means of well 6 increases to a predetermined value, preferably at least 95 percent, production of fluids from the formation by means of infill well 6 is terminated and well 6 is converted to an injection well.

Figure 5:
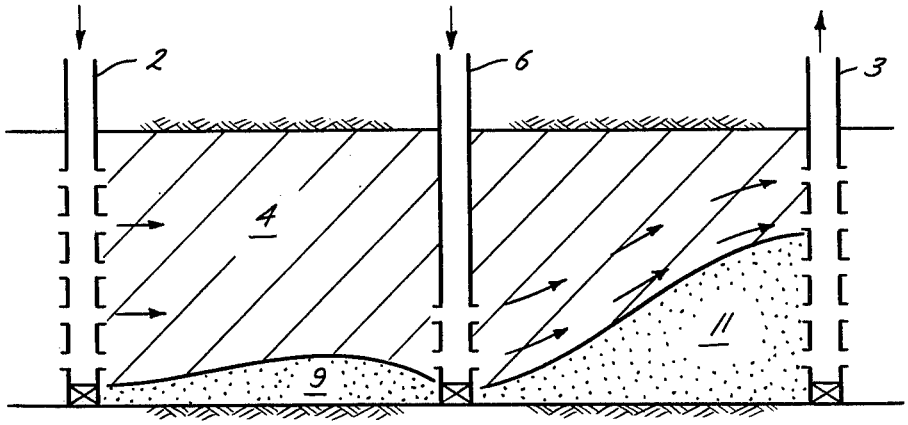
FIG. 5 illustrates the portion of the process of our invention in which steam injection is being applied to the formation by means of the infill well, illustrating steam passing through the lower portion of the recovery zone in the formation adjacent to the infill well.

After the water cut of fluids being produced from well 6 during the second phase of the process of our invention reaches the above-described levels, injection of steam into infill well 6 is thereafter initiated. Since steam enters only the lower portion of the formation 10 adjacent to the infill well, between the infill well 6 and producing well 3, as is shown in FIG. 5, a portion of zone 11 of the formation not previously swept by steam is now contacted by steam as a result of our process, and additional oil will be recovered and the unswept portion will eventually be reduced to a very small volume such as zone 12 in FIG. 6.

Figure 6:
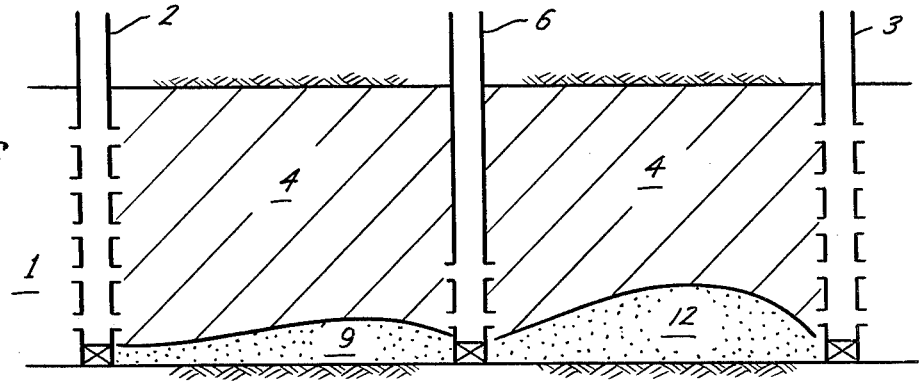
FIG. 6 illustrates the swept and unswept portion of the formation as viewed in a vertical plane, after completion of the last step in our process.

FIG. 6 illustrates the swept portion 4 and unswept portions 9 and 12 as viewed in a vertical plane, at the conclusion of our process.

The above described third step is continued with steam being injected into infill well 6 and fluid being taken from well 3 occurs to a predetermined end point. This step is preferably continued until the water cut of fluids being taken from the formation by well 3 reaches a value greater than 80 percent and preferably at least 95 percent. Continued injection (steam or water) into well 2 during this step is necessary to provide a pressure gradient and retard fluid movement from well 6 toward well 2. The rate of fluid injection into well 2 is at least sufficient to ensure maintenance of the desired pressure gradient, which is essential to avoid movement of oil back into the portion of the recovery zone between the injection well and the producing well, which would reduce the ultimate oil recovery. Preferably, the injection rate at well 2 is maintained at a value at least equal to the fluid injection rate at the infill well. In an especially preferred embodiment, the fluid injection rate at the injection well 2 is at least twice the injection rate at infill well 6. The fluid injected into well 2 during this step may be steam, hot water or unheated water. The preferred fluid is hot water, since hot water injection at well 2 while steam is being injected into well 6 not only maintains the desired pressure gradient, but also establishes liquid saturation in the flow channels of the portion of the recovery zone between the injection well 2 and infill well 6 which further aids in avoiding migration of oil in a direction from the infill well 6 toward the injection well 2.

Figure 7:
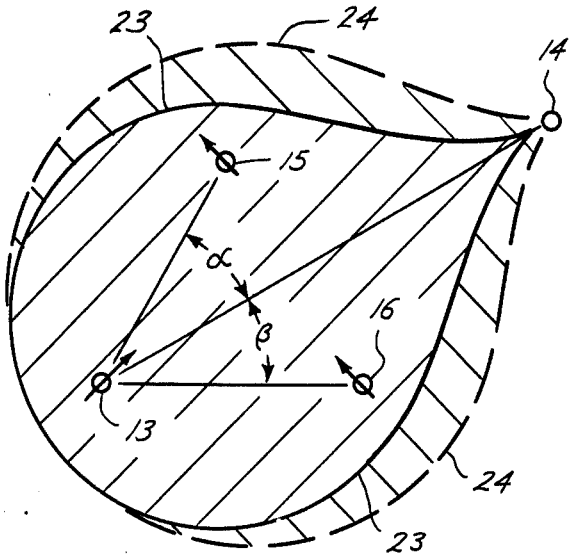
FIG. 7 illustrates the swept and unswept portion of a formation viewed in a horizontal plane, with one injection well and one producing well, illustrating the additional area as viewed in the horizontal plane swept by our process using two infill wells each offset from a line between the injection and production wells.
Figure 8:
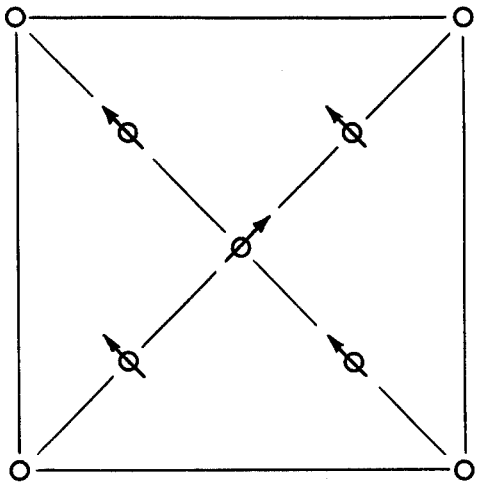
FIG. 8 illustrates an areal view of an application of our process to an inverted five spot pattern with infill wells aligned with associated injection and production wells.
Figure 9:
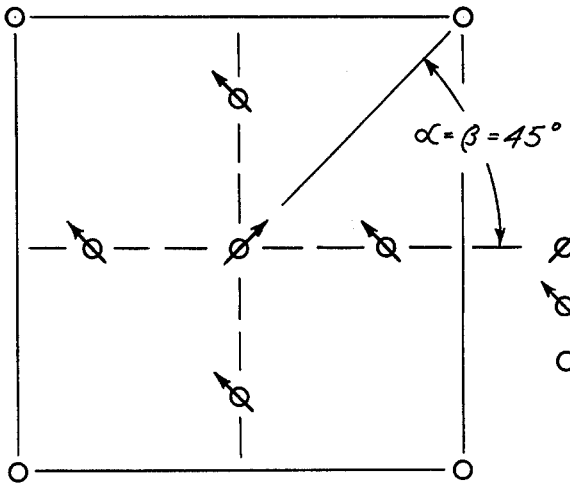
FIG. 9 illustrates an areal view of an embodiment of our process as applied to an inverted five spot with infill wells offset 45° from aligned configuration.
Figure 10:
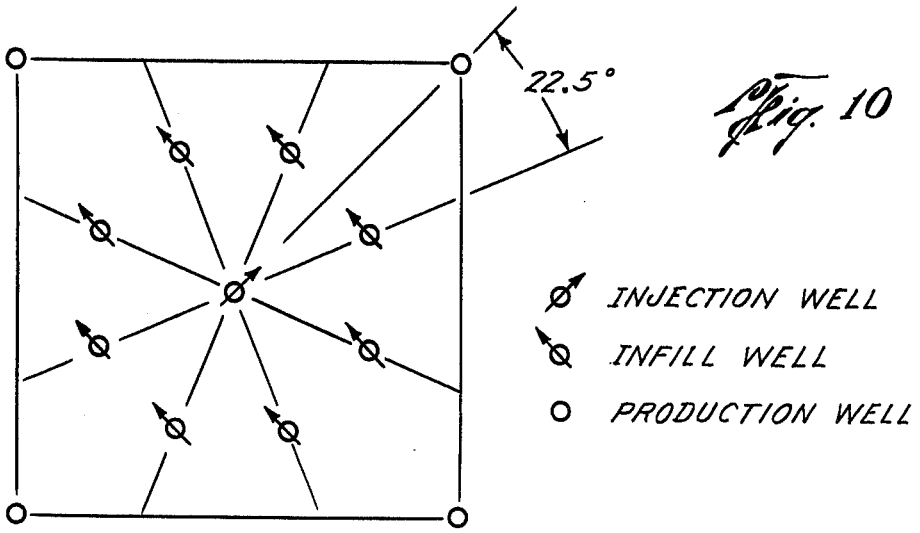
FIG. 10 illustrates an embodiment of our process illustrating a preferred application to an inverted five spot pattern with two infill wells associated with each production well, each infill well being offset 22.5° from the aligned configuration.

The above described process employing an infill well located on a line between the injection well and production well, effectively decreases the amount of formation bypassed by injected steam due to steam override, thus improving the vertical conformance, but does not improve the horizontal conformance of a steam throughput process. As is shown in FIG. 2, a significant fraction of the area defined by a horizontal plane through a group of production wells and associated injection wells arranged in any convenient pattern such as, for example, the inverted five spot, is not swept by the steam injected into the injectors. Oil present in the unswept portions of the patterns is not recovered. In a particularly preferred embodiment of the process of our invention, the horizontal conformance may be improved as well as the vertical conformance, by positioning the infill wells in strategically chosen portions of the pattern other than on a line between injection wells and production wells. This is illustrated in FIG. 7, showing areal view of injection well 13, production well 14, and infill wells 15 and 16 located on either side of a line between wells 13 and 14. The distance between injection well 13 and infill wells 15 and 16 is from 25 percent to 75 percent and preferably from 40 percent to 60 percent of the distance from the injection well to the producing well. The distance from the injector to infill well 15 is usually but not necessarily identical to the distance from the injector to the other infill well 16. The divergence in the location of infill wells 15 and 16 from a line between injection well 13 and producing well 14 is conveniently identified by angles $\alpha$ and $\beta$. Ordinarily the infill wells are symmetrically disposed relative to line 13–14 and so angle $\alpha$ will equal angle $\beta$, but nonsymmetrical arrangements are also possible and may be preferred in certain situations. The value of $\alpha$ and $\beta$ may be from 0° to 80° and preferably from 0° to 40° or so, depending on the pattern employed. The width of the recovery zone in FIG. 7 is increased from that defined by line 13 to the area within lines 14 by virtue of the use of nonaligned infill wells. In an inverted five spot, $\alpha$ and $\beta$ would vary from 0° (as is shown in FIG. 8) to 45° as is shown in FIG. 9. The greater the divergence from an aligned configuration, the greater will be the improvement in horizontal conformance. The improvement in vertical conformance may begin decreasing as the value of the divergence angle reaches the maximum value, however. In very thick formations, attainment of the maximum combination of horizontal and vertical conformance may require and justify the use of larger numbers of infill wells such as is illustrated in FIG. 10, employing eight infill wells in an inverted five spot pattern with the angles of divergence all equal to 22.5°. This is a particularly preferred embodiment, with the angle of divergence being from 15° to 30° and preferably from 20° to 25°.

EXPERIMENTAL EVALUATION

For the purpose of demonstrating the operability of the process of our invention, and of showing the magnitude of results achieved from application of a process employing infill wells such as are used in the process of our invention, the following laboratory experiments were performed.

Figure 11:
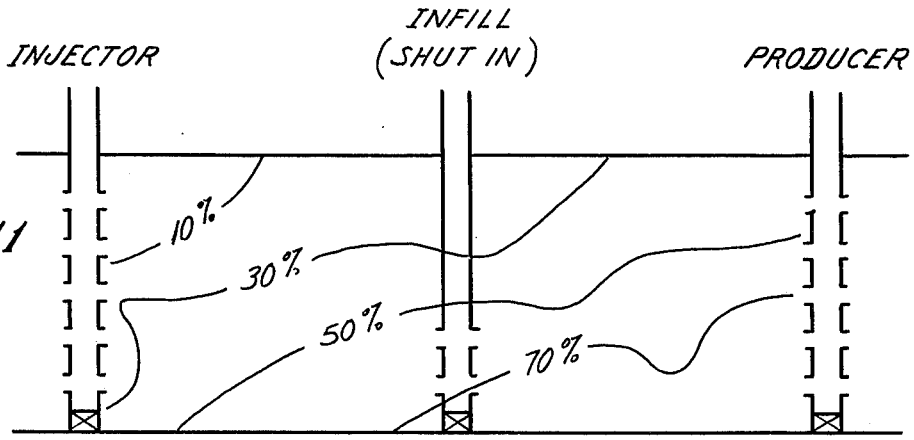
FIG. 11 illustrates the oil saturation contour lines as viewed in the vertical plane through a three-dimensional cell illustrating the oil saturation in various portions of the cell after a steam drive oil recovery process according to prior art teachings (infill well not used).
Figure 12:
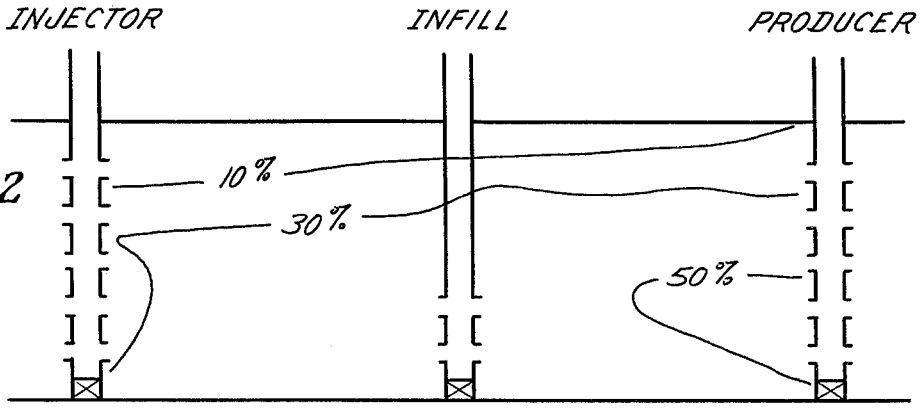
FIG. 12 illustrates the oil saturation contour lines in a three-dimensional cell illustrating the oil saturation in various portions of the cell as viewed in a vertical plane after a steam drive oil recovery process according to the process of our invention.

A laboratory cell was constructed, the cell being 3 inches wide, 8½ inches high and 18½ inches long. The cell is equipped with three wells, an injection well and production well in fluid communication with the full height of the cell and a central infill well which is in fluid communication with lower 25 percent of the cell, the well arrangement being similar to that shown in FIG. 3. A base steam drive flood was conducted in the cell to demonstrate the magnitude of the steam override problem. The cell was first packed with sand and saturated with 14 degree API gravity crude to an initial oil saturation of 53.0 percent. The infill well was not used in the first run, this run being used to simulate a conventional throughput process according to the steam drive processes described in the prior art. Oil saturation contour lines on a plane through all three wells is given in FIG. 11. After steam injection into the injection well and fluid production from the production well continued to a normal economic limit, the average residual oil saturation in the cell was 46.3 percent. In the second run, the process of our invention was applied to the cell, with steam being injected into the injection well and oil production taken from the production well until live steam breakthrough was detected at the production well, followed by production from the infill well, followed by first injecting cold water, then hot water and then steam into the cell by means of the infill well and recovering fluid from the producing well to a water cut of 98 percent. The overall residual oil saturation at the conclusion of this run was 30.1 percent compared with the initial oil saturation of 53 percent in both cases, it can be seen that the base flood recovered only 12.6 percent of the oil present in the cell whereas application of the process of our invention resulted in recovering 43 percent of the oil, or about 3.4 times as much oil as the base run. Oil saturation values were again measured throughout the cell and the oil saturation contour lines of FIG. 12 illustrates the significant improvement resulting from application of the process of our invention.

Thus we have disclosed and demonstrated in laboratory experiments how significantly more viscous oil may be recovered from an oil formation by a throughput, steam drive process by employing the process of our invention with infill wells located between injection and production wells, and a multi-step process as described above. While our invention is described in terms of a number of illustrative embodiments, it is clearly not so limited since many variations of this process will be apparent to persons skilled in the art of viscous oil recovery methods without departing from the true spirit and scope of our invention. Similarly, while mechanisms have been discussed in the foregoing description of the process of our invention, these are offered only for the purpose of complete disclosure and it is not our desire to be bound or restricted to any particular theory of operation of the process of our invention. It is our desire and intention that our invention be limited and restricted only by those limitations and restrictions appearing in the claims appended immediately hereinafter below.

We claim:

1. A method of recovering viscous petroleum from a subterranean, viscous petroleum-containing formation, said formation being penetrated by at least two wells, one injection well and one production well, both of said injection and production wells being in fluid communication with a substantial portion of the formation, said injection and production wells defining a recovery zone within the formation, comprising:

(a) penetrating the formation with at least one infill well located within the recovery zone and in fluid communication with no more than the lower 50 percent of the formation;

(b) injecting a thermal oil recovery fluid comprising steam into the injection well and recovering fluid including petroleum from the formation by the production well until the fluid being recovered from the production well comprises a predetermined amount of steam or water;

(c) thereafter recovering fluids including petroleum from the formation by the infill well until the fluid being recovered comprises a predetermined fraction of steam or water while continuing injecting said thermal oil recovery fluid into the injection well; and thereafter (d) injecting steam into the infill well and recovering fluids from the formation via the production well until the fluids being recovered comprise at least 80 percent water, and injecting an aqueous fluid into the injection well at a rate at least sufficient to maintain a positive pressure gradient between the injection well to the infill well.

2. A method as recited in claim 1 wherein steam injection into the formation according to step (b) is continued until vapor phase steam production occurs at the production well.

3. A method as recited in claim 1 wherein the production of fluids from the formation by the infill well according to step (c) is continued until the percentage of water of said fluids rises to a value of at least 80 percent.

4. A method as recited in claim 3 wherein fluid production is continued until the water content reaches 95 percent.

5. A method as recited in claim 1 wherein the step of injecting steam into the infill well as defined in step (d) is continued until the fluid being recovered from the formation is at least 95 percent water.

6. A method as recited in claim 1 wherein the distance from the injection well to the infill well is from 25 to 75 percent of the distance from the injection well to the producing well.

7. A method as recited in claim 1 wherein the distance from the injection well to the infill well is from 40 to 60 percent of the distance from the injection well to the producing well.

8. A method as recited in claim 1 wherein the infill well is located on a line connecting the injection well and the production well.

9. A method as recited in claim 1 wherein the infill well is located on a line which makes an angle of from 0° to 80° with a line through the injection and production well.

10. A method as recited in claim 1 wherein the infill well is located on a line which makes an angle of from 0° to 40° with a line through the injection and production well.

11. A method as recited in claim 1 wherein the injection and production wells are arranged in an inverted five spot pattern with a center injection well and four associated production wells spaced thereabout, with two infill wells located between the injection well and each production well, the infill wells being displaced from a line between each production well and the central injection well so a line through each infill well and the injection well forms an angle with a line through each associated production well and the injection well whose value is from 15° to 30°.

12. A method as recited in claim 11 wherein the value of the angle is from 20° to 25°.

13. A method as recited in claim 1 wherein the aqueous fluid injected into the injection well during step (d) comprises water, hot water, steam, or mixtures thereof.

14. A method as recited in claim 13 wherein the aqueous fluid is hot water.

15. A method as recited in claim 1 wherein the rate at which the aqueous fluid is injected into the injection well in step (d) is at least equal to the rate at which thermal oil recovery fluid is being injected into the infill well.

16. A method as recited in claim 15 wherein the aqueous fluid injection rate at the injection well is at least twice the thermal oil recovery fluid injection rate at the infill well.

* * * * *